US011813651B2

(12) United States Patent
He et al.

(10) Patent No.: US 11,813,651 B2
(45) Date of Patent: Nov. 14, 2023

(54) ROLLING DEVICE CAPABLE OF APPLYING HORIZONTAL VIBRATION FOR METAL CLAD PLATES

(71) Applicant: TAIYUAN UNIVERSITY OF TECHNOLOGY, Shanxi (CN)

(72) Inventors: Dongping He, Shanxi (CN); Tao Wang, Shanxi (CN); Zhihua Wang, Shanxi (CN); Ming Wang, Shanxi (CN); Jiaquan Xie, Shanxi (CN); Huidong Xu, Shanxi (CN)

(73) Assignee: TAIYUAN UNIVERSITY OF TECHNOLOGY, Shanxi (CN)

( * ) Notice: Subject to any disclaimer, the term of this patent is extended or adjusted under 35 U.S.C. 154(b) by 0 days.

(21) Appl. No.: 17/902,157

(22) Filed: Sep. 2, 2022

(65) Prior Publication Data

US 2023/0001463 A1 Jan. 5, 2023

(30) Foreign Application Priority Data

Sep. 3, 2021 (CN) ..... 202111033027.7

(51) Int. Cl.
*B21B 1/38* (2006.01)
*B21B 31/18* (2006.01)

(52) U.S. Cl.
CPC ..... *B21B 1/38* (2013.01); *B21B 31/18* (2013.01)

(58) Field of Classification Search
CPC ..... B21B 9/00; B21B 1/38; B21B 2001/383
See application file for complete search history.

(56) References Cited

U.S. PATENT DOCUMENTS

2021/0379634 A1* 12/2021 Zhao ..... B21B 1/22

FOREIGN PATENT DOCUMENTS

| | | | | |
|---|---|---|---|---|
| CN | 111389919 A | * | 7/2020 | ..... B21B 1/22 |
| CN | 112296105 A | * | 2/2021 | ..... B21B 1/38 |
| KR | 100219749 | * | 9/1999 | ..... B21B 37/00 |

OTHER PUBLICATIONS

Translation of CN-111389919 (Year: 2020).*
Translation of CN-112296105 (Year: 2021).*
Translation of KR-100219749 (Year: 1999).*

* cited by examiner

*Primary Examiner* — Bobby Yeonjin Kim

(57) ABSTRACT

A rolling device capable of applying horizontal vibration for metal clad plates includes two symmetrically arranged support frames, an upper roller and a lower roller both of which are provided between the two support frames and parallel to each other, four bearing seats which are fixed with two ends of the upper roller and two ends of the lower roller respectively, and four horizontal vibration apparatuses which are provided outside the four bearing seats respectively for driving the upper roller and the lower roller to horizontally vibrate. Every horizontal vibration apparatus includes an exciting hydraulic cylinder and a damper. One end of the exciting hydraulic cylinder and one end of the damper are fixedly connected with two sides of one of the four bearing seats respectively. Every horizontal vibration apparatus is provided outside one of the four bearing seats.

9 Claims, 6 Drawing Sheets

ROLLING DEVICE CAPABLE OF APPLYING HORIZONTAL VIBRATION FOR METAL CLAD PLATES

CROSS REFERENCE OF RELATED APPLICATION

The present invention claims priority under 35 U.S.C. 119(a-d) to CN 202111033027.7, filed Sep. 3, 2021.

BACKGROUND OF THE PRESENT INVENTION

Field of Invention

The present invention relates to the field of rolling forming technology of clad plates, and more particularly to a rolling device capable of applying horizontal vibration for metal clad plates.

Description of Related Arts

The bimetallic clad plate has the "complementary effect" while maintaining the characteristics of the base material. It is able to have excellent comprehensive performance through the appropriate ratio and combination, and is an important new material urgently needed in the national economic construction. The sandwich rolling method includes steps of contacting clean surfaces of two different metals with each other, cracking the surfaces of the metals and exposing fresh metals from cracks by plastically deforming the metals under the strong pressure of the rolling mill, and meshing the metals with each other, thereby achieving metallurgically bonding. This method has the advantages of high production efficiency, simple process and easy realization of industrialized mass production. However, in actual production, since the surfaces and the oxide layers of the two metals are low in the dislocation rate or does not reach the critical deformation force, the formed bimetallic clad plate still has the problems of low bonding strength and wide range of performance fluctuations.

SUMMARY OF THE PRESENT INVENTION

In order to solve the shortcomings and deficiencies of the prior art, it is necessary to provide a rolling device capable of applying horizontal vibration for metal clad plates, which is able to solve the problems of low bonding strength and wide range of performance fluctuations, which are caused by the facts that the surfaces and the oxide layers of the two metals are low in the dislocation rate or does not reach the critical deformation force during the rolling process of the metal clad plates.

Accordingly, the present invention provides a rolling device capable of applying horizontal vibration for metal clad plates. The rolling device comprises two symmetrically arranged support frames, an upper roller and a lower roller both of which are provided between the two support frames and parallel to each other, four bearing seats which are fixed with two ends of the upper roller and two ends of the lower roller respectively, and four horizontal vibration apparatuses which are provided outside the four bearing seats respectively for driving the upper roller and the lower roller to horizontally vibrate.

Preferably, each of the four horizontal vibration apparatuses comprises an exciting hydraulic cylinder and a damper, wherein one end of the exciting hydraulic cylinder and one end of the damper are fixedly connected with two sides of one of the four bearing seats respectively, the each of the four horizontal vibration apparatuses is provided outside the one of the four bearing seats, two guard plates with high stiffness are connected with a fixed end of the exciting hydraulic cylinder and another end of the damper respectively, two ends of one of the two guard plates are connected with one of the support frames through screws.

Preferably, two dovetail guide blocks are fixed on two of the bearing seats which are fixed with two ends of the upper roller through screws respectively, two second spherical pads are sleeved outside the two dovetail guide blocks respectively, the two second spherical pads have two spherical grooves on two surfaces thereof respectively, two screw-down screws are provided within the two spherical grooves respectively, one end of each of the two screw-down screws in contact with one of the two spherical grooves is spherical, another end of the each of the two screw-down screws is decreased in diameter and penetrates through the one of the support frames to extend outwardly, so that the support frames restrict positions of the screw-down screws.

Preferably, eight first spherical pads are installed at positions where the four bearing seats are connected with the four exciting hydraulic cylinders and the four dampers respectively, a movable end of the exciting hydraulic cylinder and a movable end of the damper are spherical, each of the eight first spherical pads wraps the movable end of the exciting hydraulic cylinder and that of the movable end of the damper, so that the risk, of damage to the exciting hydraulic cylinder and the damper caused by the deflection of the upper roller and the lower roller, is reduced.

Preferably, the rolling device further comprises four hydraulic systems for the four horizontal vibration apparatuses respectively, wherein each of the four hydraulic systems comprises a relief valve, a second port of the relief valve is connected with a main pressure oil pipe through a pipeline, a first port of the relief valve is connected with a second port of a first hydraulic one-way valve through a pipeline, a first port of the first hydraulic one-way valve is connected with a third port of a servo valve through a pipeline, a first port of the servo valve is connected with a first port of a second hydraulic one-way valve through a pipeline, a second port of the servo valve is connected with a first port of a third hydraulic one-way valve through a pipeline, a fourth port of the servo valve is connected with a main oil return pipe through a pipeline, a second port of the second hydraulic one-way valve is connected with a rodless chamber of the exciting hydraulic cylinder through a pipeline, a second port of the third hydraulic one-way valve is connected with a rod chamber of the exciting hydraulic cylinder through a pipeline, all of a third port of the first hydraulic one-way valve, a third port of the second hydraulic one-way valve and a third port of the third hydraulic one-way valve are connected with a first port of a solenoid ball valve through pipelines respectively, a second port of the solenoid ball valve is connected with a control oil pipe through a pipeline, a third port of the solenoid ball valve is connected with the main oil return pipe through a pipeline, all of a third port of the relief valve, a fourth port of the first hydraulic one-way valve, a fourth port of the second hydraulic one-way valve, and a fourth port of the third hydraulic one-way valve are connected with an oil drain pipe through pipelines respectively.

Preferably, the second port of the second hydraulic one-way valve and the rodless chamber of the exciting hydraulic cylinder are connected with a first port of an overflow valve, a second port of the overflow valve is connected with the main oil return pipe through a pipeline.

Preferably, a check valve is provided between the fourth port of the servo valve and the main oil return pipe.

Preferably, a magnetostrictive displacement sensor is provided within a piston rod of the exciting hydraulic cylinder for ensuring a position accuracy of the piston rod of the exciting hydraulic cylinder.

Preferably, the servo valve is a servo valve with differential pressure compensation.

The present invention has some beneficial effects as follows.

Compared with the prior art, in the rolling device provided by the present invention, four exciting hydraulic cylinders are in combination with four dampers for driving four bearing seats respectively to move under the cooperation of the hydraulic system, so as to achieve the high-frequency micro-stroke horizontal reciprocating movement of the upper and lower rollers. At the same time, two second spherical pads and two dovetail guide blocks work together to ensure the stability of the reciprocating movement of the upper and lower rollers.

The high-frequency micro-stroke horizontal reciprocating movement of the upper and lower rollers are able to effectively promote the dislocation of the metal and the oxide layer on the surface which is hard to deform, improve the interface bonding rate, and promote the formation of a "rolling area" at the bonding interface. In the "rolling area", the relative sliding of the bimetals is beneficial to improve the interface bonding strength, and reduce the critical deformation force required for rolling and cladding, thereby producing a clad plate with high cladding strength. In addition, the effect of reciprocating rolling is formed in the plastic deformation zone, and the bidirectional shear force is applied to the composite layer, which accelerates the diffusion of atoms at the cladding interface and strengthens the physical bonding of the cladding interface.

Figure 1:
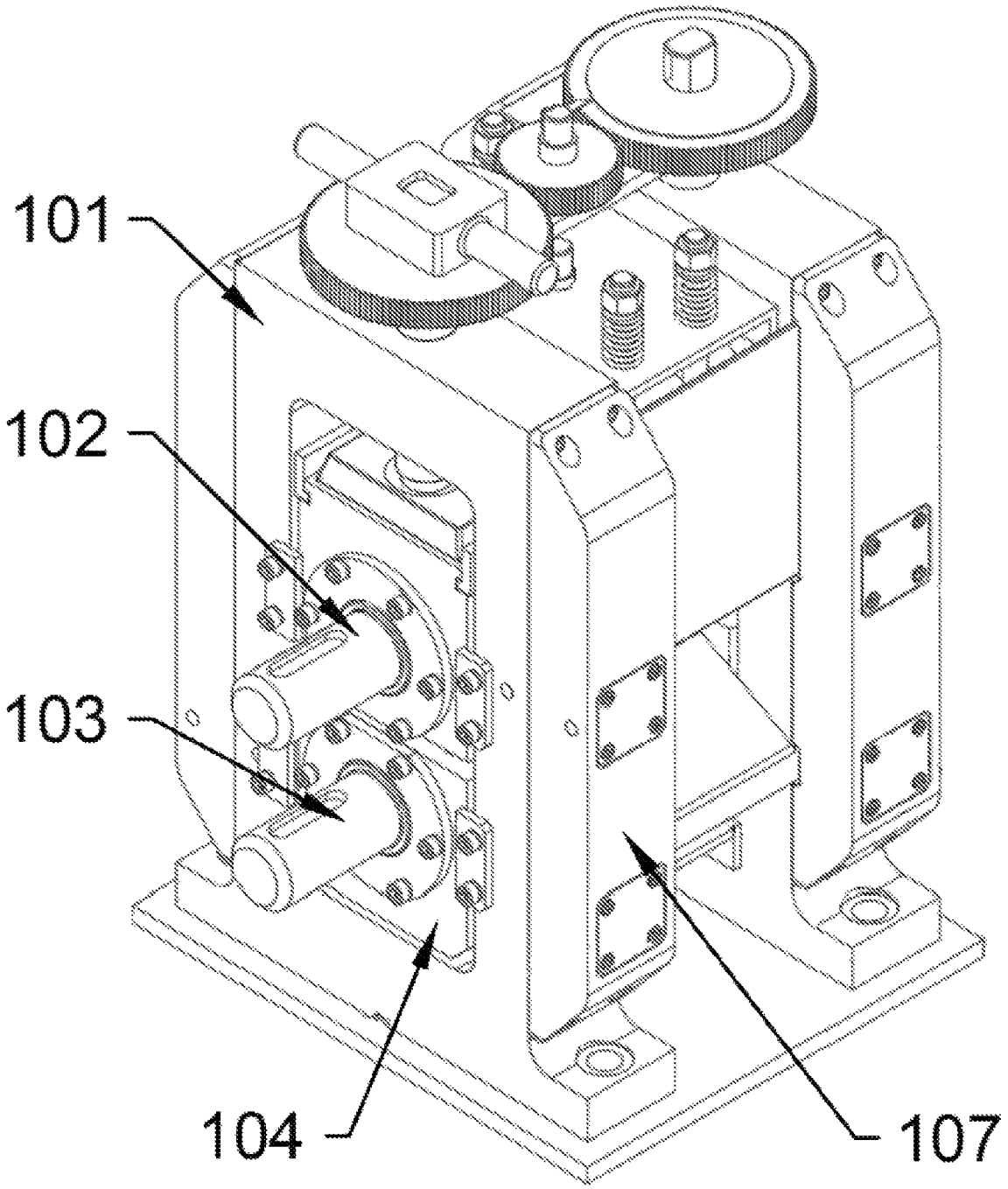
FIG. 1 is a schematic diagram of a rolling device capable of applying horizontal vibration for metal clad plates provided by the present invention.

In the drawings, 101: support frame; 102: upper roller; 103: lower roller; 104: bearing seat; 105: exciting hydraulic cylinder; 106: damper; 107: guard plate; 108: first spherical pad; 109: dovetail guide block; 110: second spherical pad; 111: screw-down screw; 112: piston rod; 1.1: relief valve; 2.1: first hydraulic one-way valve; 2.2: second hydraulic one-way valve; 2.3: third hydraulic one-way valve; 3.1: servo valve; 4.1: check valve; 5.1: solenoid ball valve; 6.1: overflow valve; 7.1: magnetostrictive displacement sensor.

DETAILED DESCRIPTION OF THE PREFERRED EMBODIMENT

The specific embodiments of the present invention will be further described in detail with accompanying drawings as follows.

Figure 2:
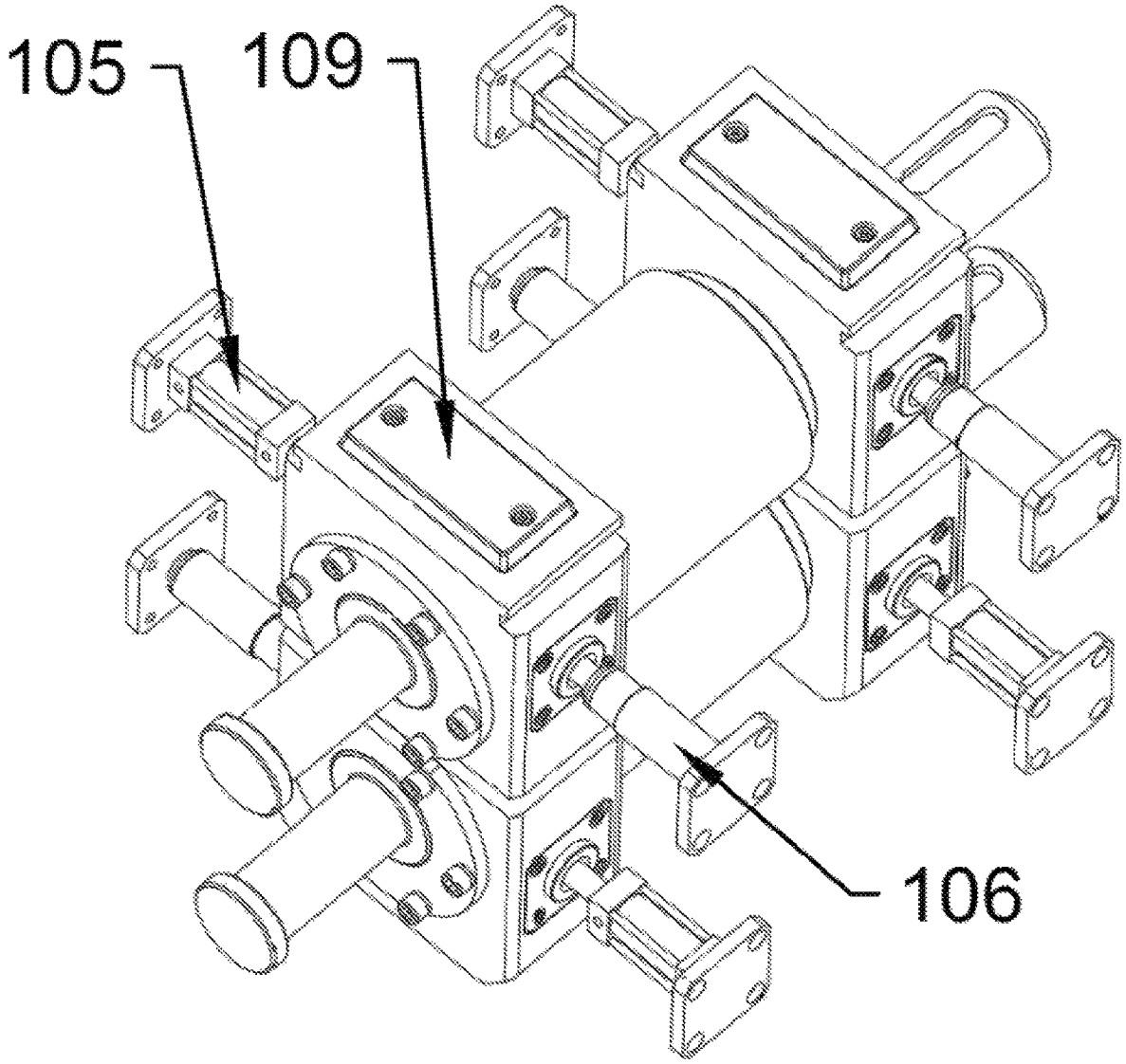
FIG. 2 is a schematic diagram of an internal structure of the rolling device provided by the present invention.
Figure 3:
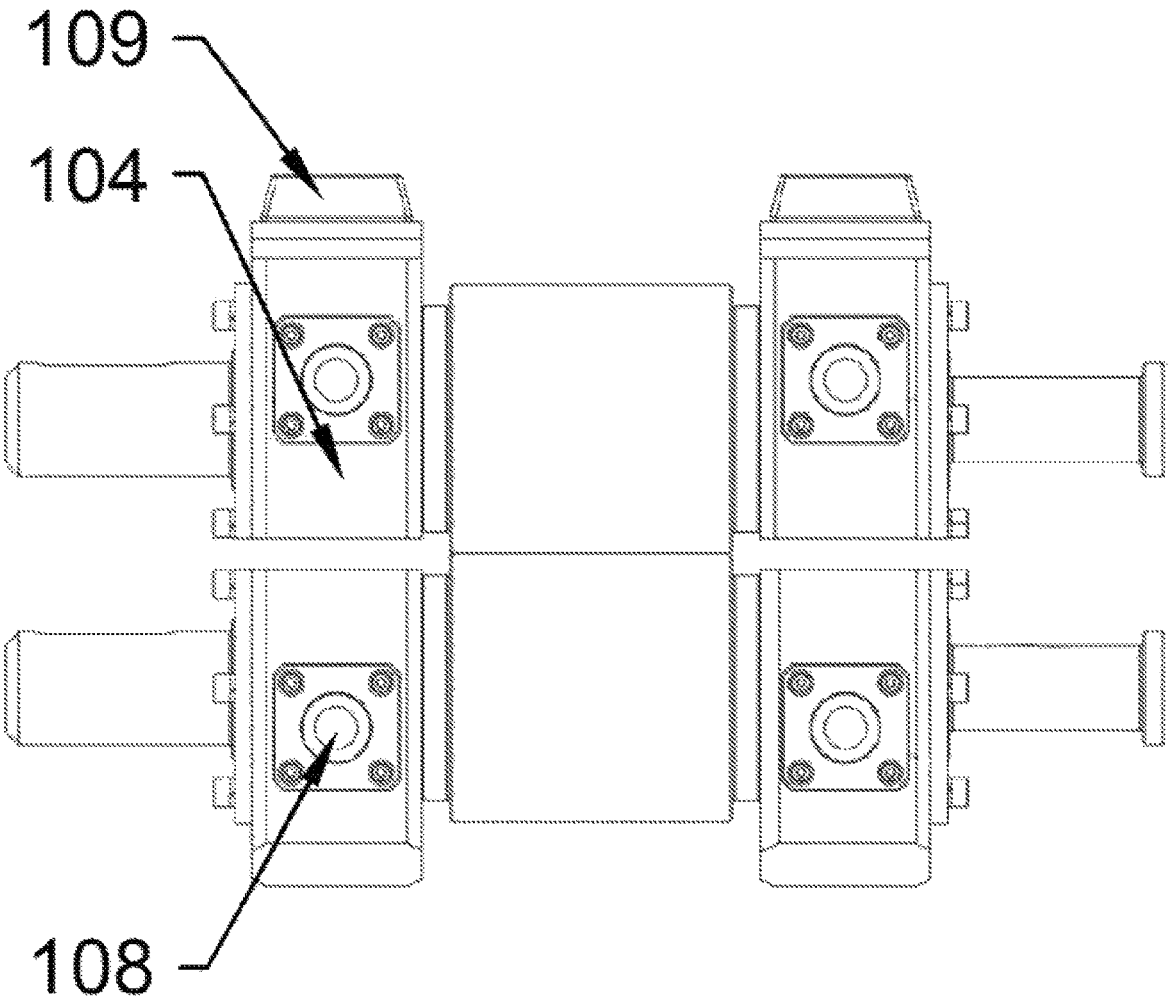
FIG. 3 is a front view of FIG. 2 without horizontal vibration apparatus.
Figure 4:
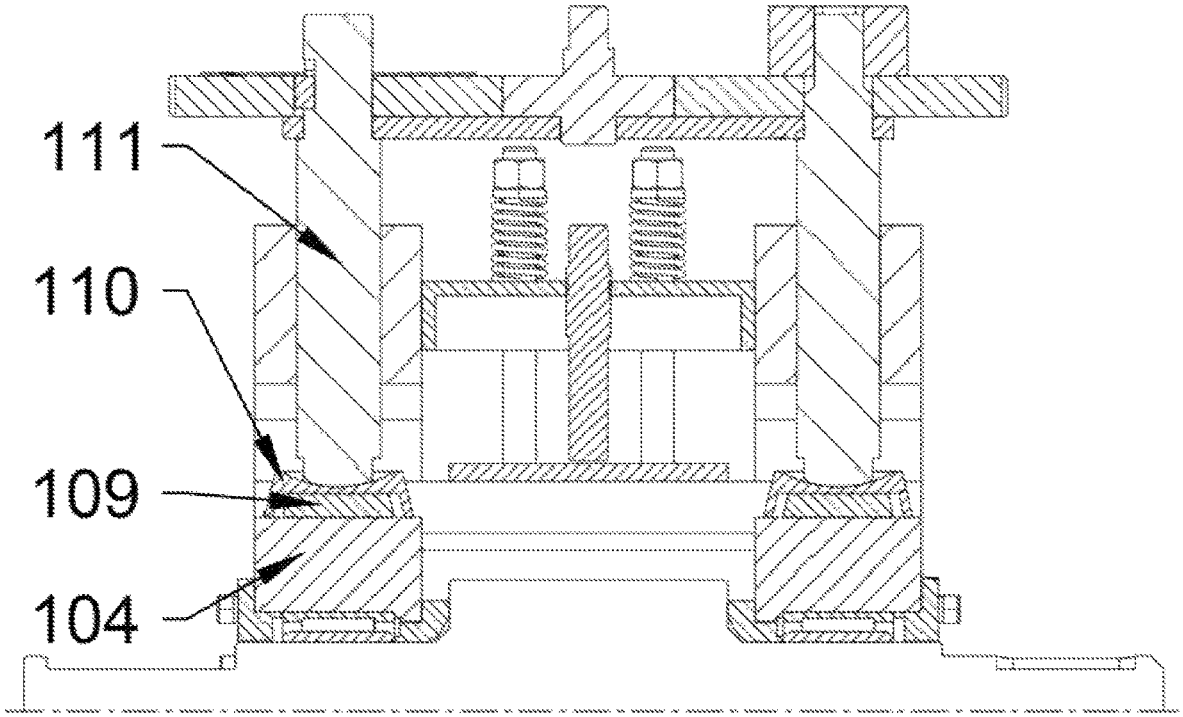
FIG. 4 is a partially sectional view of a top portion of the rolling device provided by the present invention.
Figure 5:
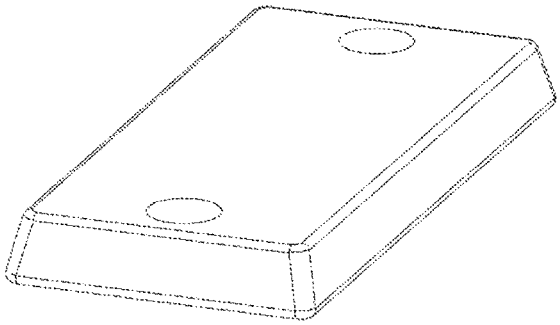
FIG. 5 is a schematic diagram of a dovetail guide block provided by the present invention.
Figure 6:
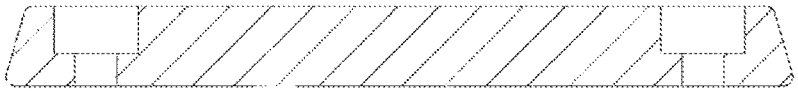
FIG. 6 is a sectional view of the dovetail guide block provided by the present invention.
Figure 7:
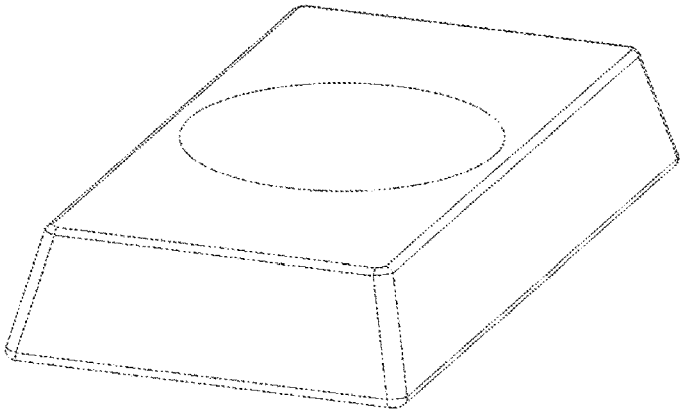
FIG. 7 is a schematic diagram of a second spherical pad provided by the present invention.
Figure 8:
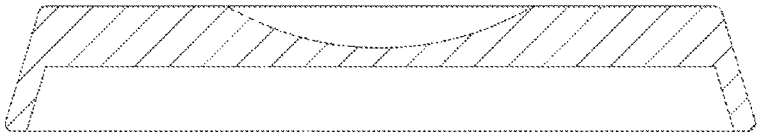
FIG. 8 is a sectional view of the second spherical pad provided by the present invention.
Figure 9:
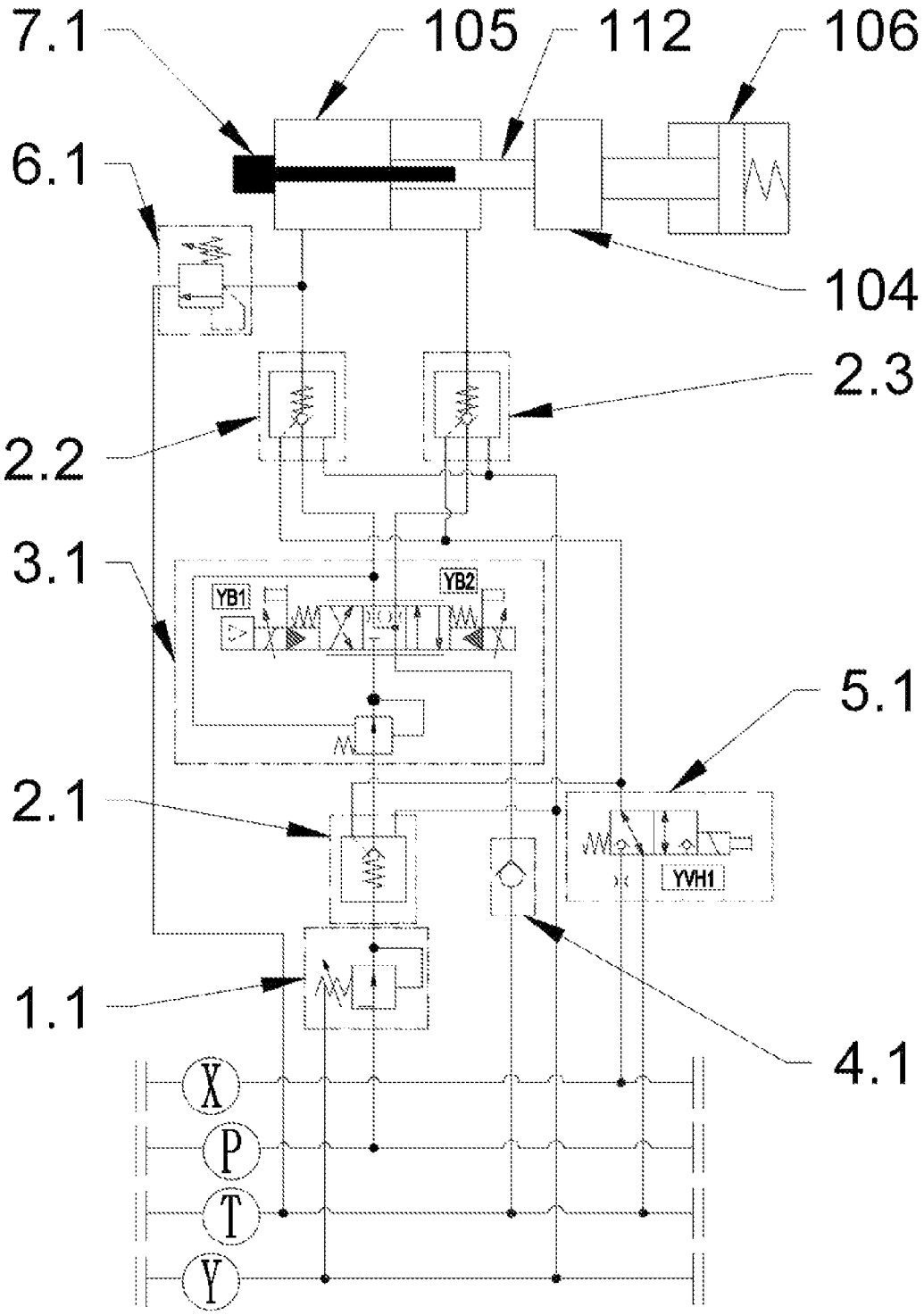
FIG. 9 is a hydraulic system diagram of a horizontal vibration apparatus provided by the present invention.

As shown in FIGS. 1-9, a rolling device capable of applying horizontal vibration for metal clad plates according to a preferred embodiment of the present invention is illustrated. The rolling device comprises two symmetrically arranged support frames 101, an upper roller 102 and a lower roller 103 both of which are provided between the two support frames 101 and parallel to each other, four bearing seats 104 which are fixed with two ends of the upper roller 102 and two ends of the lower roller 103 respectively, and four horizontal vibration apparatuses which are provided outside the four bearing seats 104 respectively for driving the upper roller 102 and the lower roller 103 to horizontally vibrate.

Each of the four horizontal vibration apparatuses comprises an exciting hydraulic cylinder 105 and a damper 106, wherein one end of the exciting hydraulic cylinder 105 and one end of the damper 106 are fixedly connected with two sides of one of the four bearing seats 104 respectively, the each of the four horizontal vibration apparatuses is provided outside the one of the four bearing seats 104, two guard plates 107 with high stiffness are connected with a fixed end of the exciting hydraulic cylinder 105 and another end of the damper 106 respectively, two ends of one of the two guard plates 107 are connected with one of the support frames 101 through screws.

Two dovetail guide blocks 109 are fixed on two of the bearing seats 104 which are fixed with two ends of the upper roller 102 through screws respectively, two second spherical pads 110 are sleeved outside the two dovetail guide blocks 109 respectively, the two second spherical pads 110 have two spherical grooves on two surfaces thereof respectively, two screw-down screws 111 are provided within the two spherical grooves respectively, one end of each of the two screw-down screws 111 in contact with one of the two spherical grooves is spherical, another end of the each of the two screw-down screws 111 is decreased in diameter and penetrates through the one of the support frames 101 to extend outwardly. Eight first spherical pads 108 are installed at positions where the four bearing seats 104 are connected with the four exciting hydraulic cylinders 105 and the four dampers 106 respectively. A movable end of the exciting hydraulic cylinder 105 and a movable end of the damper 106 are spherical. Each of the eight first spherical pads 108 wraps the movable end of the exciting hydraulic cylinder 105 and that of the movable end of the damper 106, so that the risk, of damage to the exciting hydraulic cylinder 105 and the damper 106 caused by the deflection of the upper roller 102 and the lower roller 103, is reduced.

The rolling device further comprises four hydraulic systems for the four horizontal vibration apparatuses respectively. Each of the four hydraulic systems comprises a relief valve 1.1, wherein a second port of the relief valve 1.1 is connected with a main pressure oil pipe P through a pipeline, a first port of the relief valve 1.1 is connected with a second port of a first hydraulic one-way valve 2.1 through a pipeline, a first port of the first hydraulic one-way valve 2.1 is connected with a third port of a servo valve 3.1 through a pipeline, a first port of the servo valve 3.1 is connected with a first port of a second hydraulic one-way valve 2.2 through a pipeline, a second port of the servo valve 3.1 is connected with a first port of a third hydraulic one-way valve 2.3 through a pipeline, a fourth port of the servo valve 3.1 is connected with a main oil return pipe T through a pipeline, a second port of the second hydraulic one-way valve 2.2 is connected with a rodless chamber of the exciting hydraulic cylinder 105 through a pipeline, a second port of the third hydraulic one-way valve 2.3 is connected with a rod chamber of the exciting hydraulic cylinder 105 through a pipeline, all of a third port of the first hydraulic one-way valve 2.1, a third port of the second hydraulic one-way valve 2.2 and a third port of the third hydraulic one-way valve 2.3 are connected with a first port of a solenoid ball valve 5.1 through pipelines respectively, a second port of the solenoid ball valve 5.1 is connected with a control oil pipe X through a pipeline, a third port of the solenoid ball valve 5.1 is connected with the main oil return pipe T through a pipeline, all of a third port of the relief valve 1.1, a fourth port of the first hydraulic one-way valve 2.1, a fourth port of the second hydraulic one-way valve 2.2, and a fourth port of the third hydraulic one-way valve 2.3 are connected with an oil drain pipe Y through pipelines respectively.

The second port of the second hydraulic one-way valve 2.2 and the rodless chamber of the exciting hydraulic cylinder 105 are connected with a first port of an overflow valve 6.1, a second port of the overflow valve 6.1 is connected with the main oil return pipe T through a pipeline, a check valve 4.1 is provided between the fourth port of the servo valve 3.1 and the main oil return pipe T, a magnetostrictive displacement sensor 7.1 is provided within a piston rod 112 of the exciting hydraulic cylinder 105 for ensuring a position accuracy of the piston rod 112 of the exciting hydraulic cylinder 105. The servo valve 3.1 is a servo valve with differential pressure compensation.

The working principle of the rolling device capable of applying horizontal vibration for metal clad plates provided by the present invention is explained as follows.

During the rolling process of a metal clad plate, four exciting hydraulic cylinders 105 are in combination with four dampers 106 respectively to reciprocate horizontally like a "spring". When high-pressure oil is introduced into the rodless chamber of one exciting hydraulic cylinder 105, the piston rod 112 extends outwardly, a corresponding damper 106 is compressed. When the rodless chamber of the exciting hydraulic cylinder 105 is unloaded, the damper 106 releases energy to drive the piston rod 112 to retract. Two piston rods of two exciting hydraulic cylinders 105 at both sides of the upper roller 102 extend and retract at the same time, and always act in synchrony. Similarly, two piston rods of two exciting hydraulic cylinders 105 at both sides of the lower roller 103 extend and retract at the same time, and always act in synchrony. The position accuracy of the piston rod of every exciting hydraulic cylinder 105 is ensured by the position closed loop which is formed by the magnetostrictive displacement sensor 7.1 and the servo valve 3.1.

The rolling process of the metal clad plate specifically comprises steps of:

(1) compressing the damper 106 by introducing high-pressure oil into the rodless chamber of the exciting hydraulic cylinder 105, which comprises energizing a second torque motor YB2 of the servo valve 3.1 and an electromagnet YVH1 of the solenoid ball valve 5.1 at the same time; oil from the main pressure oil pipe P passing through the relief valve 1.1 from the second port to the first port thereof, and then passing through the first hydraulic one-way valve 2.1 from the second port to the first port thereof, and then passing through the servo valve 3.1 from the third port to the first port thereof, and then passing through the second hydraulic one-way valve 2.2 from the first port to the second port thereof, and flowing into the rodless chamber of the exciting hydraulic cylinder 105; oil from the rod chamber of the exciting hydraulic cylinder 105 passing through the third hydraulic one-way valve 2.3 from the second port to the first port thereof, and then passing through the servo valve 3.1 from the second port to the fourth port thereof, and then passing through the check valve 4.1, and flowing into the main oil return pipe T, so as to drive the piston rod 112 of the exciting hydraulic cylinder 105 to extend outwardly to compress the damper 106; and (2) the damper 106 working by unloading the rodless chamber of the exciting hydraulic cylinder 105, which specifically comprises energizing a first torque motor YB1 of the servo valve 3.1 and the electromagnet YVH1 of the solenoid ball valve 5.1 at the same time; oil from the main pressure oil pipe P passing through the relief valve 1.1 from the second port to the first port thereof, and then passing through the first hydraulic one-way valve 2.1 from the second port to the first port thereof, and then passing through the servo valve 3.1 from the third port to the second port thereof, and then passing through the third hydraulic one-way valve 2.3 from the first port to the second port thereof, and flowing into the rod chamber of the exciting hydraulic cylinder 105; oil from the rodless chamber of the exciting hydraulic cylinder 105 passing through the second hydraulic one-way valve 2.2 from the second port to the first port thereof, and then passing through the servo valve 3.1 from the first port to the fourth port thereof, and then passing through the check valve 4.1, and flowing into the main oil return pipe T, so as to drive the piston rod 112 of the exciting hydraulic cylinder 105 to retract and drive the damper 106 to work.

Through the horizontal reciprocating movement of four exciting hydraulic cylinders 105 and four dampers 106, the high-frequency (80-100 Hz) micro-stroke (1-3 mm) horizontal reverse reciprocating movement of the upper roller 102 and the lower roller 103 is able to be ensured, which promotes the formation of a "rolling area" at the bonding interface of the metal clad plate. In the "rolling area", the relative sliding of the bimetals is beneficial to improve the interface bonding strength, and reduce the critical deformation force required for rolling and cladding. In addition, under an action of horizontal vibration, the effect of reciprocating rolling is formed in the plastic deformation zone, and the bidirectional shear force is applied to the composite layer, which accelerates the diffusion of atoms at the cladding interface and strengthens the physical bonding of the cladding interface, thereby producing the metal clad plate with high cladding strength.

The above embodiments are not limited to the technical solutions of the embodiments themselves, and the embodiments are able to be combined with each other to form new embodiments. The above embodiments are only used to illustrate the technical solutions of the present invention and are not the limitation to the present invention. Any modifications or equivalent replacements that do not depart from the spirit and scope of the present invention should be included within the scope of the technical solutions of the present invention.

What is claimed is:

1. A rolling device capable of applying horizontal vibration for metal clad plates, the rolling device comprising two symmetrically arranged support frames, an upper roller and a lower roller both of which are provided between the two support frames and parallel to each other, four bearing seats which are fixed with two ends of the upper roller and two ends of the lower roller respectively, and four horizontal vibration apparatuses which are provided outside the four bearing seats respectively for driving the upper roller and the lower roller to horizontally vibrate.

2. The rolling device according to claim 1, wherein each of the four horizontal vibration apparatuses comprises an exciting hydraulic cylinder and a damper, wherein one end of the exciting hydraulic cylinder and one end of the damper are fixedly connected with two sides of one of the four bearing seats respectively, the each of the four horizontal vibration apparatuses is provided outside the one of the four bearing seats, two guard plates with high stiffness are connected with a fixed end of the exciting hydraulic cylinder and another end of the damper respectively, two ends of one of the two guard plates are connected with one of the support frames through screws.

3. The rolling device according to claim 2, wherein two dovetail guide blocks are fixed on two of the bearing seats which are fixed with two ends of the upper roller through screws respectively, two second spherical pads are sleeved outside the two dovetail guide blocks respectively, the two second spherical pads have two spherical grooves on two surfaces thereof respectively, two screw-down screws are provided within the two spherical grooves respectively, one end of each of the two screw-down screws in contact with one of the two spherical grooves is spherical, another end of the each of the two screw-down screws is decreased in diameter and penetrates through the one of the support frames to extend outwardly, so that the support frames restrict positions of the screw-down screws.

4. The rolling device according to claim 3, wherein eight first spherical pads are installed at positions where the four bearing seats are connected with the four exciting hydraulic cylinders and the four dampers respectively, a movable end of the exciting hydraulic cylinder and a movable end of the damper are spherical, each of the eight first spherical pads wraps the movable end of the exciting hydraulic cylinder and that of the movable end of the damper, so that the risk, of damage to the exciting hydraulic cylinder and the damper caused by the deflection of the upper roller and the lower roller, is reduced.

5. The rolling device according to claim 4, further comprising four hydraulic systems for the four horizontal vibration apparatuses respectively, wherein each of the four hydraulic systems comprises a relief valve, a second port of the relief valve is connected with a main pressure oil pipe, a first port of the relief valve is connected with a second port of a first hydraulic one-way valve, a first port of the first hydraulic one-way valve is connected with a third port of a servo valve, a first port of the servo valve is connected with a first port of a second hydraulic one-way valve, a second port of the servo valve is connected with a first port of a third hydraulic one-way valve, a fourth port of the servo valve is connected with a main oil return pipe, a second port of the second hydraulic one-way valve is connected with a rodless chamber of the exciting hydraulic cylinder, a second port of the third hydraulic one-way valve is connected with a rod chamber of the exciting hydraulic cylinder, all of a third port of the first hydraulic one-way valve, a third port of the second hydraulic one-way valve and a third port of the third hydraulic one-way valve are connected with a first port of a solenoid ball valve respectively, a second port of the solenoid ball valve is connected with a control oil pipe, a third port of the solenoid ball valve is connected with the main oil return pipe, all of a third port of the relief valve, a fourth port of the first hydraulic one-way valve, a fourth port of the second hydraulic one-way valve, and a fourth port of the third hydraulic one-way valve are connected with an oil drain pipe respectively.

6. The rolling device according to claim 5, wherein the second port of the second hydraulic one-way valve and the rodless chamber of the exciting hydraulic cylinder are connected with a first port of an overflow valve, a second port of the overflow valve is connected with the main oil return pipe.

7. The rolling device according to claim 5, wherein a check valve is provided between the fourth port of the servo valve and the main oil return pipe.

8. The rolling device according to claim 5, wherein a magnetostrictive displacement sensor is provided within a piston rod of the exciting hydraulic cylinder for ensuring a position accuracy of the piston rod of the exciting hydraulic cylinder.

9. The rolling device according to claim 5, wherein the servo valve is a servo valve with differential pressure compensation.

* * * * *